United States Patent [19]

New et al.

[11] Patent Number: 4,764,704

[45] Date of Patent: Aug. 16, 1988

[54] COLOR CATHODE-RAY TUBE HAVING A THREE-LENS ELECTRON GUN

[75] Inventors: David A. New; Loren L. Maninger, both of Lancaster, Pa.

[73] Assignee: RCA Licensing Corporation, Princeton, N.J.

[21] Appl. No.: 128,951

[22] Filed: Dec. 4, 1987

[30] Foreign Application Priority Data

Jan. 14, 1987 [GB] United Kingdom ..... 8700792
Jan. 14, 1987 [GB] United Kingdom ..... 8700793

[51] Int. Cl.[4] ..... H01J 29/62
[52] U.S. Cl. ..... 313/414; 313/449
[58] Field of Search ..... 313/414, 449, 458, 460, 313/413

[56] References Cited

U.S. PATENT DOCUMENTS

| | | | |
|---|---|---|---|
| 3,919,583 | 11/1975 | Hasker et al. | 313/448 |
| 4,143,293 | 3/1979 | Hosokoshi et al. | 313/409 |
| 4,241,275 | 12/1980 | Yamauchi | 313/413 |
| 4,242,613 | 12/1980 | Brambring et al. | 313/447 |
| 4,251,747 | 2/1981 | Burdick | 313/348 |
| 4,322,655 | 3/1982 | Takenaka et al. | 313/471 |
| 4,366,414 | 12/1982 | Hatayama et al. | 313/409 |
| 4,620,133 | 10/1986 | Morrell et al. | 315/15 |
| 4,641,058 | 2/1987 | Koshigoe et al. | 313/449 |
| 4,678,964 | 7/1987 | Peels | 313/414 |

OTHER PUBLICATIONS

Takenaka et al., "New Hi-Fi Focus Electron Gun for Color Cathode-Ray Tube", Toshiba Review, No. 121, 30 (1979).

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

The present invention provides an improvement in color cathode-ray tubes. Such tubes include an electron gun for generating and directing three inline beams, a center beam and two side beams, along initially coplanar paths toward a screen of the tube. The gun includes a plurality of spaced electrodes which provide a first, a second and a third lens for focusing the electron beams. The first lens has a beam forming region for providing substantially symmetrical beams to the second lens. The improvement comprises the combination of the second and third lens. The second lens includes at least one electrode to provide asymmetrically-shaped beams. The potentials applied to the second lens refract electron beams emerging off-axes from the first lens toward the axes. The third lens is a low aberration main focusing lens which provides asymmetrically-shaped beams of substantially constant current density to the screen.

11 Claims, 8 Drawing Sheets

COLOR CATHODE-RAY TUBE HAVING A THREE-LENS ELECTRON GUN

BACKGROUND OF THE INVENTION

The invention relates to a color cathode-ray tube having an electron gun with three electron lenses, and, more particularly, to a three-lens electron gun capable of providing asymmetrically-shaped electron beams of substantially constant current density.

FIG. 1 shows a conventional rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 by a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of the FIG. 1). Alternatively, the screen could be a dot screen. A multi-apertured color selection electrode or shadow mask 24 is removably mounted, by conventional means, in predetermined spaced relation to the screen 22. An inline electron gun 26, shown schematically by dashed lines in FIG. 1, is centrally mounted within the neck 14 to generate and direct three electron beams 28 along initially coplanar beam paths through the mask 24 and toward the screen 22. One type of electron gun that is conventional is a four grid bi-potential electron gun such as that shown in FIG. 2 and described in U.S. Pat. No. 4,620,133 issued to Morrell et al. on Oct. 28, 1986, which is assigned to the assignee of the present invention and is incorporated by reference herein for the purpose of disclosure.

The tube of FIG. 1 is designed to be used with an external magnetic deflection yoke, such as yoke 30 located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially from the yoke 30 into the region of the gun 26. For simplicity, the actual curvature of the deflected beam paths in the deflection zone is not shown in FIG. 1. The yoke 30 provides an inhomogeneous magnetic field that has a strong pin cushion-like vertical deflection magnetic field and a strong barrel-like horizontal deflection magnetic field to converge the electron beams at the peripheral part of the screen 22. When the electron beams pass through such an inhomogeneous magnetic field, the beams are subject to distortions and defocusing. As a result, at the peripheral portions of the screen 22 the shape of the electron beam spot is greatly distorted. FIG. 3 represents an electron beam spot for a single beam which is circular at the center of the screen and undergoes various types of distortions at the periphery of the screen 22. As shown in FIG. 3, the beam spot becomes horizontally elongated when deflected along the horizontal axis. The beam spot at the four corners of the screen comprises a combination of horizontally elongated portions and vertically elongated portions that form elliptically-shaped spots with halo-shaped elongations thereabout. The resolution is degraded as the electron beam is deflected, and the non-uniform focusing cannot be neglected and presents a problem which must be addressed.

The aforementioned U.S. Pat. No. 4,620,133 addresses the beam focus problem by providing an improved color imaging display system that includes a deflection yoke and an electron gun that has both an improved beam forming region, comprising a first grid, G1, a second grid, G2, a third grid, G3, and an improved main focusing lens, G3-G4, which works in conjunction with the deflection yoke and the beam forming region to provide an improved beam spot at the screen 22. FIG. 4*a* shows an electron beam current density contour, at the center of the screen 22, for an electron beam produced by the beam forming region and the main lens of the electron gun shown in FIG. 2. The beam current of the electron gun is 4 milliamperes. The electron beam current density contour of FIG. 4*a* comprises a relatively large center portion having a substantially constant beam current of about 50% of the average beam current, and peripheral portions where the beam current drops to about 5% of the average beam current and finally to about 1% of the average beam current. The beam is elliptically-shaped along the vertical axis to reduce the overfocusing action of the yoke when the beam is deflected. FIG. 4*b* shows the beam current density contour within the main lens, L2, that is between the G3 and G4 electrodes of FIG. 2. The electron beam at this location is horizontally elongated; however, the 50% beam current density portion is contained within the small elliptical center section of the beam which is circumscribed by the larger elliptical portions which represent the 5% and 1% beam current density profiles. FIG. 4*c* shows the electron beam current density contour of the electron beam deflected into the upper right hand corner of the screen. Some haloing occurs above and below the central portion of the beam. FIG. 5 depicts the paths of the electrons emerging from the beam forming region of the electron gun of FIG. 2 for various beam currents. In FIG. 5*a* the beam current is adjusted to 4 milliamperes and a crossover point occurs at about 2.8 to 2.9 mm (110 to 115 mils) from the cathode located at the origin. At a distance of about 5.2 mm (200 mils) from the origin, the electrons are concentrated in the center portion of the beam. This distribution of electrons produces the current density contour at the screen, shown in FIG. 4*a*. The effect of beam current on the location of the crossover point and on the beam current density contour is shown in FIGS. 5*b* and 5*c*. In FIG. 5*b*, when the beam current is decreased to 0.8 milliamperes, the crossover point is shifted to a location about 1.14 mm (45 mils) from the cathode. It is apparent that the divergence angle of the electron beam is somewhat less at an operating current of 0.8 milliamperes than at an operating current of 4.0 milliamperes (FIG. 5*a*). In FIG. 5*c* at a beam current of 0.2 milliamperes, the crossover point is located less than about 0.6 mm (25 mils) from the cathode and the beam is virtually a laminar beam.

U.S. Pat. No. 4,641,058 issued to Koshigoe et al. on Feb. 3, 1987 also discloses a four-grid bi-potential electron gun in which a prefocused astigmatic lens is formed between the second and third grids and a main astigmatic focus lens is formed between the third and fourth grids. The advantage of the patentees' two-lens structure over prior bi-potential structures is that unlike various types of prior bi-potential electron guns, such as that shown in FIG. 2, which provide an astigmatic shape to the electron beam by means of the first grid, the patentees have utilized the second and/or third grids as the first astigmatic lens. The latter structure allegedly permits the astigmatic electron beam formed by the first astigmatic lens to be compensated for in the main astigmatic focus lens to provide a substantially circular-shaped beam spot on a phosphor screen of a cathode ray tube. The structure described in the Koshigoe et al. patent is also applied to a composite lens type electron gun having six grids and three separate electron lenses such as that shown in FIG. 6. In the six grid structure of Koshigoe et al., the first (prefocus) lens, L1, is formed between the second and third grids, the third, fourth, and fifth grids constitute a sub-lens, L2, and the fifth and sixth grids constitute a main lens, L3. In this latter embodiment, the first (prefocus) lens serves as the first astigmatic lens and the main lens serves as the second astigmatic lens. The patentees claim that the deflected beam spot in this electron gun is superior to that obtained in prior art electron guns. However, in such an electron gun structure the location of the crossover point is dependent upon the beam current of the electron gun. While the first asymmetric lens, L1, is formed in the region between the second and third grid electrodes, G2 and G3 respectively, the crossover point may occur either before or after lens L1, depending upon the electron beam current. At a high beam current of about 4 milliamperes (ma), the crossover point occurs after the lens L1, i.e. closer to the G3 electrode. Thus, the asymmetric effect of lens L1 is a function of beam current. It is therefore desirable to provide an electron lens which is insensitive to the beam current, i.e., the asymmetric lens should be located beyond the crossover point, regardless of the operating beam current of the electron gun. Additionally, it is desirable to have a gun structure which provides beams of substantially constant current density, in both the horizontal and vertical directions, in the main lens.

SUMMARY OF THE INVENTION

The present invention provides an improvement in color picture tubes. Such tubes include an electron gun for generating and directing three electron beams, a center beam and two side beams, along initially coplanar paths towards the screen of the tube. The gun includes a plurality of spaced electrodes which provide a first lens including a beam forming region for providing substantially symmetrical beams to a second lens. The second lens includes beam refraction means for refracting the electron beams, emerging off the axis from the first lens, toward the axis, and asymmetric beam-focusing means for providing asymmetrically shaped beams to a third lens. The third lens is a low aberration main focusing lens for providing an asymmetrically shaped beam of substantially constant current density to the screen.

DETAILED DESCRIPTION OF THE PREFERRED EMBODIMENTS

Figures 7, 8:
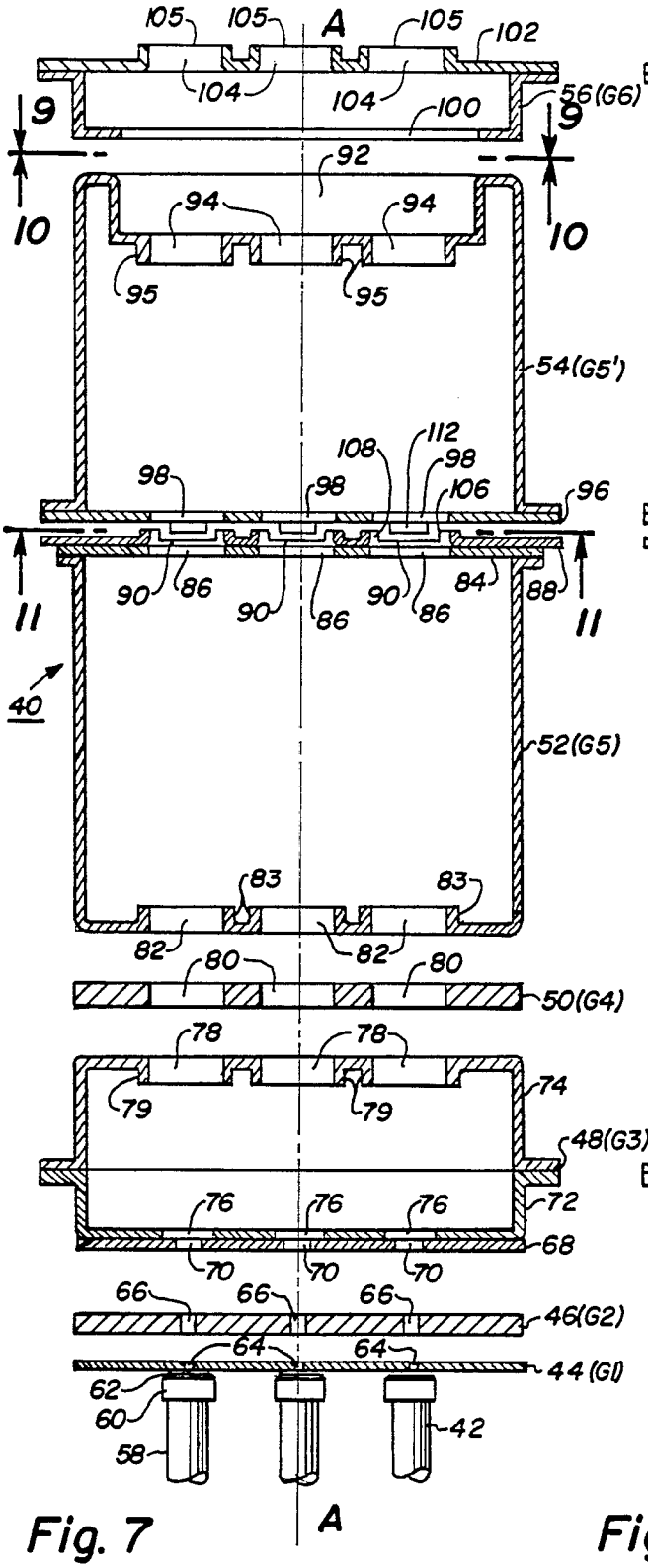
FIGS. 7 and 8 are axial top and side views, respectively, of an electron gun according to the present invention.

The details of a novel electron gun 40 are shown in FIGS. 7 and 8. The gun 40 comprises three equally spaced coplanar cathodes 42 (one for each beam), a control grid 44 (G1), a screen grid 46 (G2), a third electrode 48 (G3), a fourth electrode 50 (G4), a fifth electrode 52 (G5), the G5 electrode includes a portion G5' identified as element 54, and a sixth electrode 56 (G6). The electrodes are spaced in the order named from the cathodes and are attached to a pair of support rods (not shown).

The cathodes 42, the G1 electrode 44, the G2 electrode 46 and a portion of the G3 electrode 48 facing the G2 electrode 46 comprise a beam forming region of the electron gun 40. Another portion of the G3 electrode 48, the G4 electrode 50 and the G5 electrode 52 comprise a first asymmetric lens. The portion 54 of the G5′ electrode and the G6 electrode 56 comprise a main focusing (or second asymmetric) lens.

Each cathode 42 comprises a cathode sleeve 58 closed at its forward end by a cap 60 having an end coating 62 of an electron emissive material thereon, as is known in the art. Each cathode 42 is indirectly heated by a heater coil (not shown) positioned within the sleeve 58.

Figure 1:
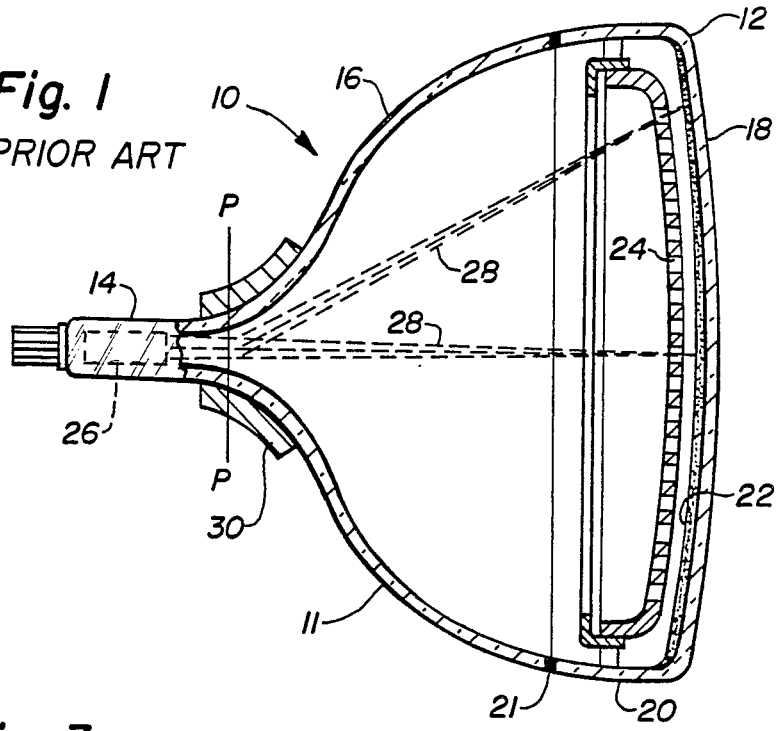
Fig. 1 PRIOR ART
FIG. 1 is a plan view partially in axially section of a conventional color cathode-ray tube.
Figure 3:
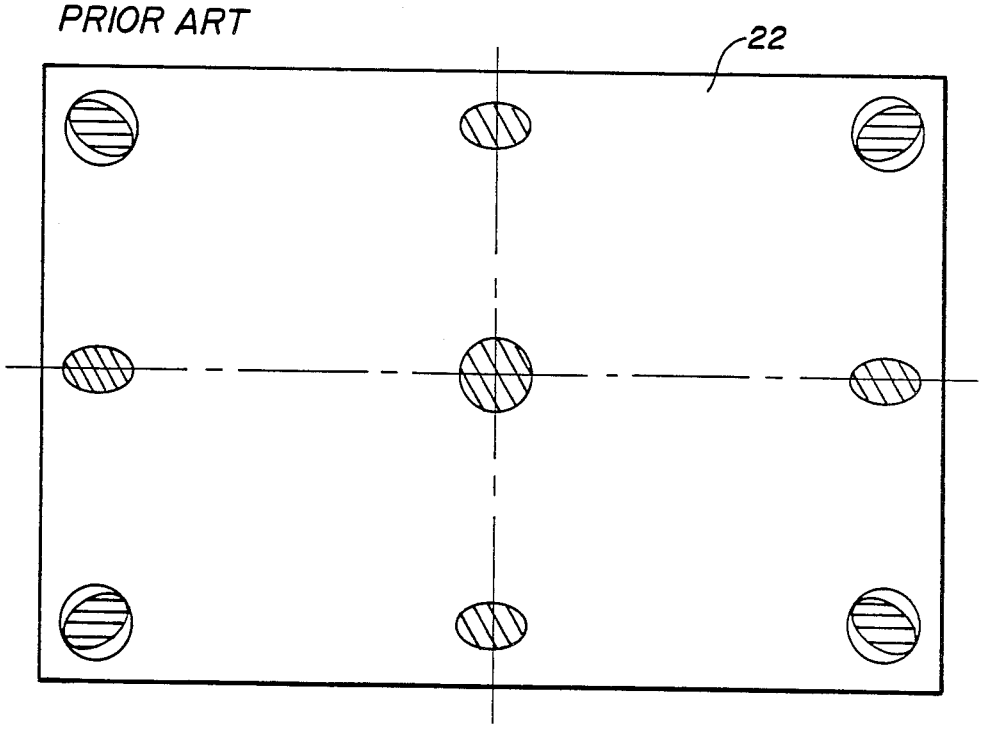
Fig. 3 PRIOR ART
FIG. 3 is a representation showing the shapes of electron beam spots on the screen of a conventional color cathode-ray tube.

The G1 and G2 electrodes, 44 and 46, are two closely spaced substantially flat plates each having three pairs of inline apertures 64 and 66, respectively, therethrough. The apertures 64 and 66 are centered with the cathode coating 62 to initiate three equally-spaced coplanar electron beams 28 (shown in FIG. 1) directed towards the screen 22. Preferably, the initial electron beam paths are substantially parallel, with the middle path coinciding with the central axis A—A of the electron gun.

The G3 electrode 48 includes a substantially flat outer plate portion 68 having three inline apertures 70 therethrough which are aligned with the apertures 66 and 64 in the G2 and G1 electrodes 46 and 44, respectively. The G3 electrode 48 also includes a pair of cup-shaped first and second portions 72 and 74, respectively, which are joined together at their open ends. The first portion 72 has three inline apertures 76 formed through the bottom of the cup which are aligned with the aperture 70 in the plate 68. The second portion 74 of the G3 electrode has three apertures 78 formed through its bottom which are aligned with the apertures 76 in the first portion 72. Extrusions 79 surround the apertures 78. Alternatively, the plate portion 68 with its inline apertures 70 may be formed as an internal part of the first portion 72, The G4 electrode 50 comprises a substantially flat plate having three inline apertures 80 formed therethrough which are aligned with the apertures 78 in the G3 electrode.

The G5 electrode 52 is a deep-drawn cup-shaped member having three apertures 82, surrounded by extrusions 83, formed in the bottom end thereof. A substantially flat plate member 84 having three apertures 86, aligned with the apertures 82, is attached to and closes the open end of the G5 electrode 52. A first plate portion 88, having a plurality of openings 90 therein, is attached to the opposite surface of the plate member 84.

The G5′ electrode 54 comprises a deep-drawn cup-shaped member having a recess 92 formed in the bottom end with three inline apertures 94 formed in the bottom surface thereof. Extrusions 95 surround the apertures 94. The opposite open end of the G5′ electrode 54 is closed by a second plate portion 96 having three openings 98 formed therethrough which are aligned with and cooperate with the openings 90 in the first plate portion 88 in a manner to be described hereinafter.

The G6 electrode 56 is a cup-shaped deep-drawn member having a large opening 100 at one end through which all three electron beams pass and an open end which is attached to and closed by a plate member 102 that has three apertures 104 therethrough which are aligned with the apertures 94 in the G5′ electrode 54. Extrusions 105 surround the apertures 104.

Figure 9:
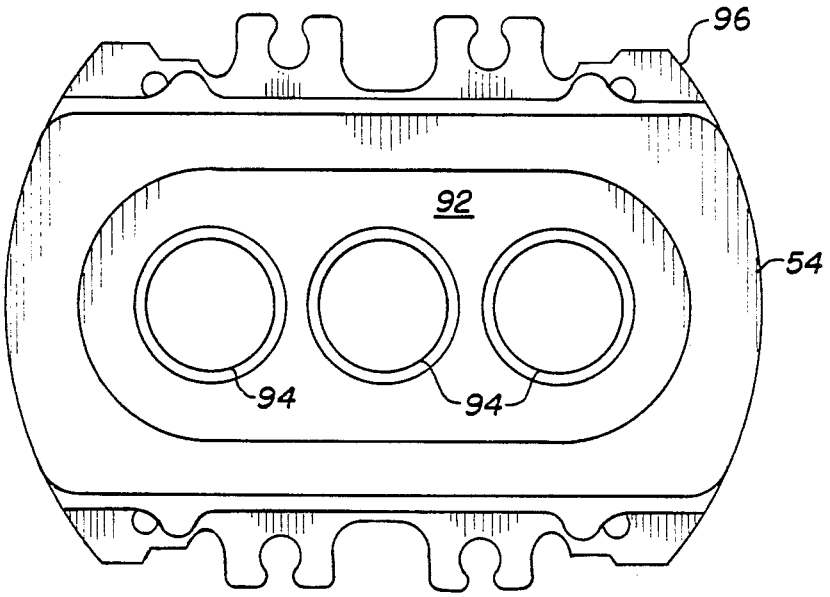

The shape of the recess 92 in the G5′ electrode 54 is shown in FIG. 9. The recess 92 has a uniform vertical width at each of the electron beam paths with rounded ends. Such a shape has been referred to as the "racetrack" shape.

Figure 10:
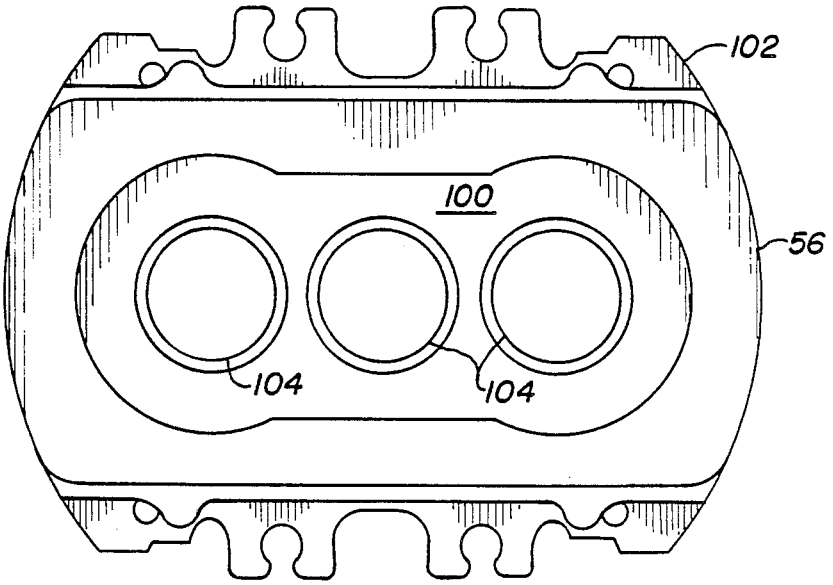

The shape of the large aperture 100 in the G6 electrode 56 is shown in FIG. 10. The aperture 100 is vertically higher at the side electron beam paths that it is at the center beam path. Such a shape has been referred to as the "dogbone" or "barbell" shape.

Figure 11:
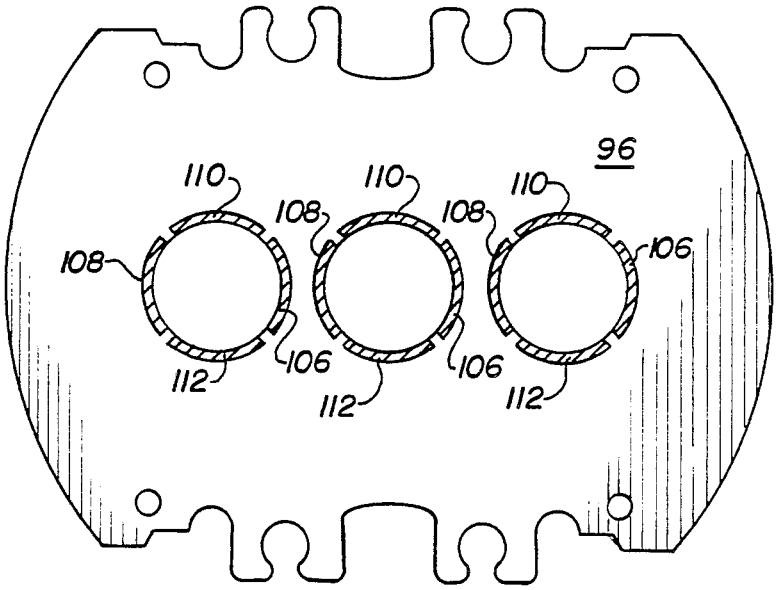
FIGS. 9, 10 and 11 are sectional views of the electron gun shown in FIG. 7, taken along lines 9—9, 10—10 and 11—11, respectively.
Figure 4A:
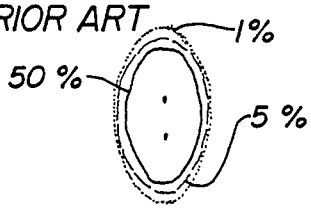
Fig. 4a PRIOR ART
FIG. 4*a* shows the electron beam current density contour at the center of the screen, for the electron gun of FIG. 2.
Figure 4B:
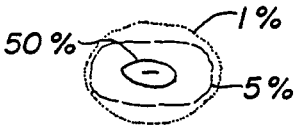
Fig. 4b PRIOR ART
FIG. 4*b* shows the electron beam current density contour within the main lens and FIG. 4*c* shows the current density contour for the electron beam deflected to the upper right hand corner of FIG. 3.
Figure 4C:
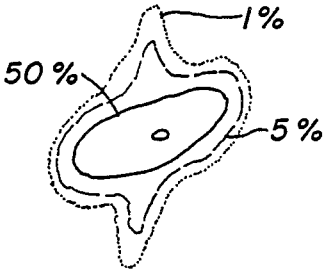
Fig. 4c PRIOR ART
Figure 5A:
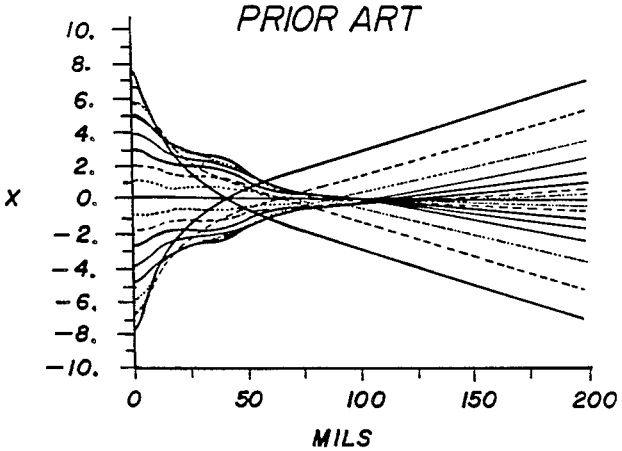
Fig. 5a PRIOR ART
FIG. 5*a* shows the electron beam ray diagram for the beam forming region of the electron gun of FIG. 2 operating at a beam current of 4.0 milliamperes.
Figure 5B:
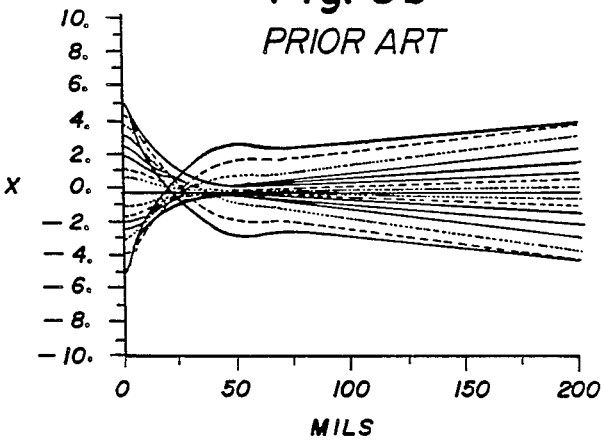
Fig. 5b PRIOR ART
FIG. 5*b* shows that same electron gun operating at a beam current of 0.8 milliamperes.
Figure 5C:
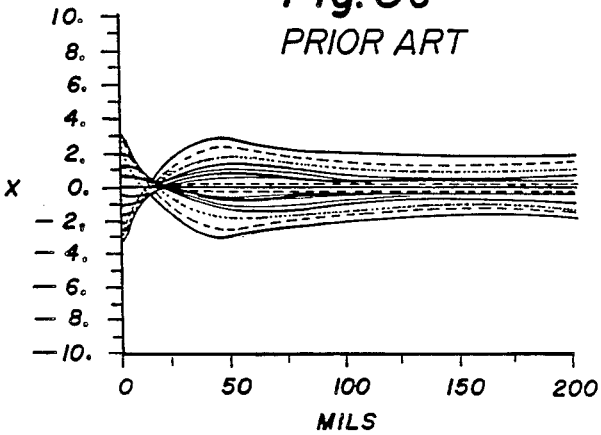
Fig. 5c PRIOR ART
FIG. 5*c* shows that same electron gun operating at a beam current of 0.2 milliamperes.

The first plate portion 88 of the G5 electrode 52 faces the second plate portion 96 of the G5′ electrode 54. The apertures 90 in the first plate portion 88 of the G5 electrode 52 have extrusions extending from the plate portion that have been divided into two segments 106 and 108 for each aperture. The apertures 98 in the second plate portion 96 of the G5′ electrode 54 also have extrusions extending from the plate portion 96 that have been divided into two segments 110 and 112 for each aperture. As shown in FIG. 11, the segments 106 and 108 are interleaved with the segments 110 and 112. These segments are used to create quadrupole lenses in the paths of each electron beam when different potentials are applied to the G5 and G5′ electrodes 52 and 54, respectively. By proper application of a dynamic voltage differential to either the G5 electrode 52 or the G5′ electrode 54, it is possible to use the quadrupole lenses established by the segments 106, 108, 110 and 112 to provide an astigmatic correction to the electron beams to compensate for astigmatisms occurring in either the electron gun or in the deflection yoke. Such a quadrupole lens structure is described in copending U.S. patent application, Ser. No. 075,784 filed on July 20, 1987 by R. C. Alig et al. now U.S. Pat. No. 4,737,682 which is incorporated by reference herein for the purpose of disclosure. The Alig et al. application is assigned to the assignee of the present invention.

GENERAL CONSIDERATIONS

Specific dimensions of a computer-modeled electron gun for a first preferred embodiment are presented in TABLE I.

TABLE I

| | Inches | mm |
|---|---|---|
| K-G1 spacing | 0.003 | 0.08 |
| Thickness of G1 electrode 44 | 0.0025 | 0.06 |
| Thickness of G2 electrode 46 | 0.024 | 0.61 |
| G1 and G2 aperture diameter | 0.025 | 0.64 |
| G1 to G2 spacing | 0.010 | 0.25 |
| G2 to G3 spacing | 0.030 | 0.76 |
| Thickness of G3 plate portion 68 | 0.010 | 0.25 |
| G3 aperture diameter | 0.040 | 1.02 |
| Length of G3 electrode | 0.200 | 5.08 |
| Thickness of G4 electrode 50 | 0.035 | 0.89 |
| G4 electrode aperture size | 0.166 H × 0.160 V | 4.22 H × 4.06 V |
| G3 to G4 spacing | 0.050 | 1.27 |
| Overall length of G5 and G5′ electrodes 52 and 54 | 0.890 | 22.61 |
| G4 to G5 spacing | 0.050 | 1.27 |
| Spacing between plate portions 88 and 96 | 0.040 | 1.02 |
| Length of recess 92 | 0.715 | 18.16 |
| Vertical height of recess 92 | O.315 | 8.00 |
| Depth of recess 92 | 0.115 | 2.92 |
| Length of G6 electrode | 0.130 | 3.30 |
| G5 to G6 spacing | 0.050 | 1.27 |
| Diameter of apertures 78, 82, 90 94, 98 and 104 | 0.160 | 4.06 |
| Center-to-center aperture spacing | 0.200 | 5.08 |
| Length of aperture 100 | 0.698 | 17.73 |
| Vertical height of aperture 100 at center beam | 0.267 | 6.78 |
| Vertical height of aperture 100 at outer beams | 0.280 | 7.11 |
| Depth of aperture 100 | 0.115 | 2.92 |

TABLE I-continued

| | Inches | mm |
|---|---|---|
| Length of G3 extrusions 79 | 0.035 | 0.89 |
| Length of G5 extrusions 83 | 0.029 | 0.74 |
| Length of G5' extrusions 95 | 0.034 | 0.86 |
| Length of G6 extrusions 105 | 0.045 | 1.14 |

Figure 6:
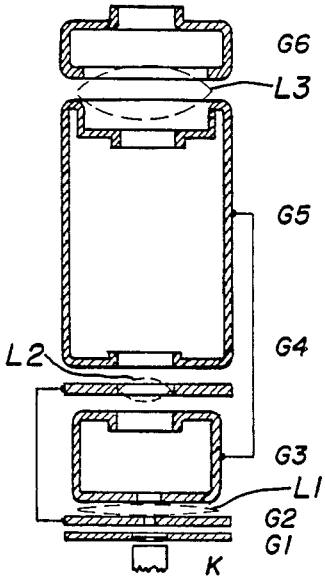
FIG. 6 is a schematic sectional view showing a six grid electron gun operating with the second and fourth grids at a first potential and the third and fifth grids at a second potential.

In the embodiment presented in TABLE I, the electron gun is electrically connected as shown in FIG. 6. Typically, the cathode operates at about 150 V, the G1 electrode at ground potential, the G2 and G4 electrodes are electrically interconnected and operate within the range of about 300 V to 1000 V, the G3 and G5 electrodes also are electrically interconnected and operate at about 7 kV and the G6 electrode operates at an anode potential of about 25 kV.

While the electrical parameters of the preferred embodiment are similar to those described in U.S. Pat. No. 4,641,058, referenced herein, the structural differences in the present electron gun provide superior performance.

Figure 12:
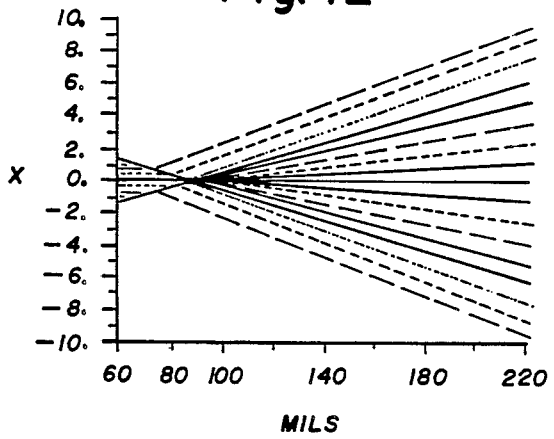
FIG. 12 shows the electron beam ray diagram for the beam forming region of the present electron gun.
Figure 13:
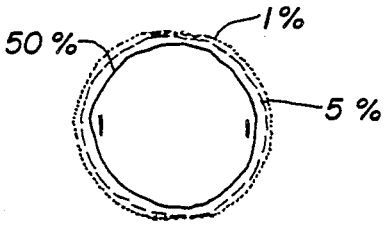
FIG. 13 shows the electron beam current density contour from the beam forming region (first lens) of the present electron gun.

In the present electron gun 40 the first lens, L1, (FIG. 6) provides a symmetrically-shaped high quality electron beam rather than an asymmetrically-shaped electron beam into the second lens, L2. The beam has a large divergence angle of about 120 milliradians and an electron distribution as shown by the ray diagram in FIG. 12. The crossover for the electron beam, operating at about 4 ma occurs at a distance of about 0.090 inch (2.3 mm) from the cathode. The corresponding beam current density contour of one of the beams is shown in FIG. 13. It can be seen that the present beam forming region does not introduce any appreciable asymmetry into the electron beam.

Figure 14:
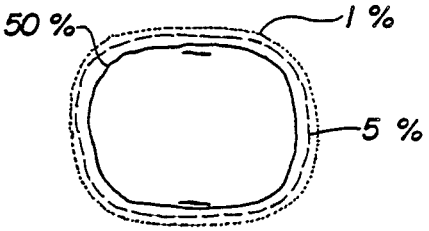
FIG. 14 shows the electron beam current density contour within the main lens produced by the second lens of the present electron gun, connected as shown in FIG. 6.

In the present electron gun 40 the second lens L2, comprising the G4 electrode 50 and the adjacent portions of the G3 electrode 48 and the G5 electrode 52, constitutes an asymmetric lens which provides a horizontally-elongated electron beam which, within the third or main focus lens, L3, has the beam spot contour shown in FIG. 14. The substantially rectangular shape of the electron beam is produced by the rectangular apertures 80 formed through the G4 electrode 50. Since the vertical dimensions of the apertures 80 are less than the horizontal dimensions and the adjacent G3 and G5 electrodes operate at a potential greater than the potential on the G4 electrode, there is stronger vertical focusing of the beams prior to entering the main lens, L3. In the event that a slight misalignment of about 0.001 inch (0.025 mm) occurs in the apertures 64, 66 and 70 of the beam-forming region, the potential on the G4 electrode 50 (and on the interconnected G2 electrode 46) refracts the electrons of the electron beams emerging off-axes from the beam-forming region toward the axes.

The main focus lens, L3, formed between the G5' electrode 54 and the G6 electrode 56 also is a low aberration, asymmetric lens which provides a vertically-elongated, or asymmetrically-shaped, electron beam spot at the center of the screen. The resultant beam spot, shown in FIG. 15*a*, has a substantially gaussian current density contour. As shown in FIG. 15*b*, deflection of the beam to the upper right corner of the screen causes substantial elongation of the central 50% region of the beam with enlarged regions or halos of lower intensity surrounding the central region.

Figure 15A:
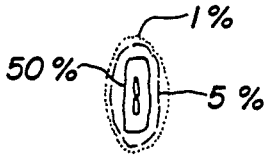
FIGS. 15*a*, 15*b* and 15*c* show the beam current density contour of the present electron gun, connected as shown in FIG. 6, at the center of the screen, deflected to the upper right corner of the screen, and at the same deflected location on the screen but with a dynamic correction voltage applied to one electrode of the main (third) lens.
Figure 15B:
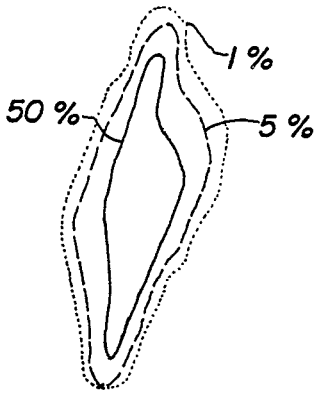
Figure 15C:
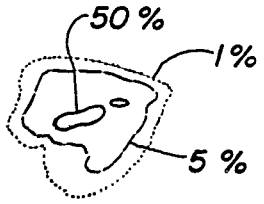

By applying to the G5' electrode 54 a dynamic differential focus voltage that ranges from the potential on G5, with no deflection, to about 1000 volts more positive than the voltage applied to the G5 electrode 52, at maximum deflection, the deflected electron beam current density contour can be improved as shown in FIG. 15*c*.

Figure 2:
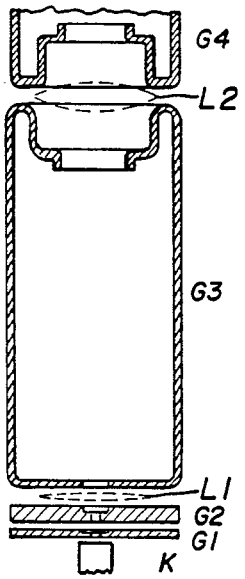
Fig. 2 PRIOR ART
FIG. 2 is a schematic sectional view showing an overall construction of a bi-potential four-grid electron gun.

A variation of the above-described first embodiment can be achieved by replacing the rectangular apertures 80 in the G4 electrode 50 with round apertures having a diameter of 0.160 inch (4.06 mm), decreasing the thickness of the G4 electrode to 0.025 inch (0.64 mm) and increasing the G6 electrode "dogbone" dimensions to an aperture 100 length of 0.703 inch (17.86 mm)×vertical height of aperture 100 at center beam of 0.275 inch (6.99 mm)×vertical height of aperture 100 at outer beams of 0.290 inch (7.37 mm). Additionally, the overall length of the G5 electrode and G5' electrode is increased to 0.900 inch (22.86 mm). The resultant beam spot size predicted on the screen at the 5% density profile is comparable to that of the prior electron gun shown in FIG. 2.

A second embodiment of the computer modeled electron gun 40 shown in FIGS. 7 and 8 is presented in TABLE II. The beam forming region of the electron gun of the second embodiment is identical to the beam-forming region of the first embodiment and like numbers are used to designate like tube elements throughout the electron gun.

TABLE II

| | Inches | mm |
|---|---|---|
| K-G1 spacing | 0.003 | 0.08 |
| Thickness of G4 electrode 50 | 0.030 | 0.76 |
| G4 electrode aperture size | 0.160 H × 0.168 V | 4.06 H × 4.27 V |
| G3 to G4 spacing | 0.050 | 1.27 |
| Overall length of G5 and G5' electrodes 52 and 54 | 0.890 | 22.61 |
| G4 to G5 spacing | 0.050 | 1.27 |
| Spacing between the plate portions 88 and 96 | 0.040 | 1.02 |
| Length of recess 92 | 0.715 | 18.16 |
| Vertical height of recess 92 | 0.315 | 8.00 |
| Depth of recess 92 | 0.115 | 2.92 |
| Length of G6 electrode | 0.130 | 3.30 |
| G5 to G6 spacing | 0.050 | 1.27 |
| Diameter of apertures 78, 82, 90 94, 98 and 104 | 0.160 | 4.06 |
| Center-to-center aperture spacing | 0.200 | 5.08 |
| Length of aperture 100 | 0.693 | 17.60 |
| Vertical height of aperture 100 at center beam | 0.260 | 6.60 |
| Vertical height of aperture 100 at outer beams | 0.270 | 6.86 |
| Depth of aperture 100 | 0.115 | 2.92 |
| Length of G3 extrusions 79 | 0.035 | 0.89 |
| Length of G5 extrusions 83 | 0.029 | 0.74 |
| Length of G5' extrusions 95 | 0.034 | 0.86 |
| Length of G6 extrusions 105 | 0.045 | 1.14 |

Figure 16:
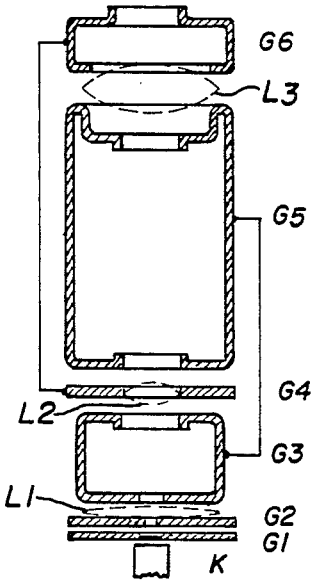
FIG. 16 is a schematic sectional view showing a second embodiment of a six grid electron gun operating with the third and fifth grids at a third potential and the fourth and sixth grids at a fourth potential.

In the embodiment presented in TABLE II, the electron gun 40 is electrically connected as shown in FIG. 16. Typically, the cathode operates at about 150 V, the G1 electrode at ground potential and the G2 electrode at about 400 V. The G3 electrode is electrically interconnected to the G5 electrode and operates at about 7 kV, and the G4 electrode is electrically interconnected to the G6 electrode which operates at an anode potential of about 25 kV.

In the present electron gun the first lens, L1, (FIG. 16) provides a symmetrically-shaped high quality electron beam into the second lens, L2. Since the beam-forming region of the second embodiment is identical to that of the first embodiment, FIGS. 12 and 13 also show, respectively, the electron distribution and beam current density contour for one of the electron beams therefrom.

Figure 17:
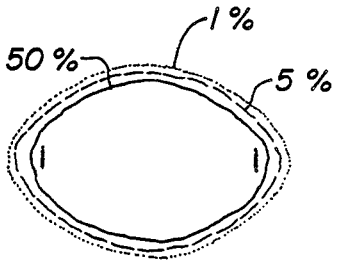
FIG. 17 shows the electron beam current density contour within the main lens produced by the second embodiment of the present electron gun connected as shown in FIG. 16.
Figure 18:
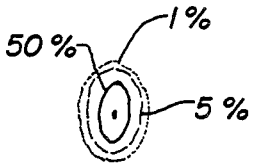
FIG. 18 shows the electron beam current density contour at the center of the screen for the second embodiment of the present electron gun connected as shown in FIG. 16.

In the second embodiment, the second electron lens, L2, comprising the G4 electrode 50, the adjacent portions of the G3 electrode 48 and the G5 electrode 52, constitute an asymmetric lens which provides a horizontally-elongated, elliptically-shaped electron beam which, within the third or main focus lens, L3, has the beam current density contour shown in FIG. 17. The elliptical shape of the beam is produced by the interaction of the rectangular apertures 80 in the G4 electrode 50 and voltage gradients in the second lens, L2. FIG. 18 shows the resultant beam current density contour of an electron beam at the center of the screen. Since the horizontal dimension of the apertures 80 in the second embodiment are less than the vertical dimension and the adjacent G3 and G5 electrodes operate at a potential less than the potential on the G4 electrode, weaker horizontal focusing of the beams occur prior to entering the main lens, L3.

Despite the differences in structure and operating voltages between the first and second embodiments of the electron gun 40 presented in TABLES I and II, the beam contours shown in FIGS. 15*a* and 18 are similar and demonstrate that acceptable performance can be achieved utilizing either embodiment. The electrical configuration shown in FIG. 6 is preferred because the anode potential is not introduced into the lower voltage region of the electron gun.

A primary advantage of the embodiments presented in TABLES I and II over prior six-electrode electron guns such as that described in U.S. Pat. No. 4,641,058 is that in the present structures, the initial asymmetric lens, L2, is located beyond the electron beam crossover point. Accordingly, the asymmetric effect of lens, L2, on the beam spot size and current density contour on the screen is relatively independent of the beam current. Additionally, the present structures provide beams of substantially constant current density, in both the horizontal and vertical directions, in the main lens.

The embodiments described herein are exemplary of the invention and are not meant to be limiting. For example, the rectangular apertures of the second embodiment of the G4 electrode 50 can be replaced with apertures of other suitable geometric shapes to provide an asymmetric second lens. Additionally, the focus voltage on the G3 and G5 electrodes can be selected to vary the strength of the electron lenses in the electron gun.

What is claimed is:

1. In a color cathode-ray tube including an envelope having therein an inline electron gun for generating and directing three inline electron beams along initially coplanar paths towards a screen on an interior portion of said envelope, said gun including a plurality of spaced electrodes which provide a first lens, a second lens and a third lens for focusing said electron beams, said first lens including a beam-forming region for providing substantially symmetrical beams to said second lens, the improvement comprising said second lens including beam refraction means for refracting said electron beams, emerging off said axes from said first lens, toward said axes, and asymmetric beam-focusing means for providing asymmetrically-shaped beams to said third lens, and said third lens being a low aberration main focusing lens for providing asymmetrically-shaped beams of substantially constant current density to said screen.

2. In a color cathode-ray tube including an envelope having therein an inline electron gun for generating and directing three inline electron beams along initially coplanar axes towards a screen on an interior portion of said envelope, said gun including three cathodes and six electrodes spaced therefrom, each of said electrode having three opening therein for the passage of said beams therethrough, said gun having a first lens comprising a first electrode, a second electrode and a first portion of a third electrode, a second lens comprising a second portion of said third electrode, a fourth electrode and a first portion of a fifth electrode, and a third lens comprising a second portion of said fifth electrode and a sixth electrode, said first lens including a beam-forming region for providing substantially symmetrical beams to said second lens, the improvement comprising said second lens having beam refraction means for refracting said electron beams, emerging off said axes from said first lens, toward said axes, and asymmetric beam focusing means for providing asymmetrically-shaped beams to said third lens, and said third lens being a low aberration main focusing lens for providing asymmetrically-shaped beams of substantially constant current density to said screen.

3. The tube as described in claim 2, wherein said second lens includes at least one electrode for producing three elliptically shaped electron beams.

4. The tube as described in claim 2, wherein said fourth electrode has three rectangularly-shaped openings therein for producing said asymmetrically-shaped electron beams.

5. The tube as described in claim 4, wherein each of said openings has a horizontal dimension which is greater than a vertical dimension, thereby providing stronger vertical focusing of the beams prior to entering the main focus lens.

6. The tube as described in claim 5, wherein said second electrode and said fourth electrode operate at a first potential, and said third electrode and said first portion of said fifth electrode operate at a second potential which is more positive than said first potential, said sixth electrode operates at a third potential more positive than said first and said second potentials.

7. The tube as described in claim 6, wherein said second portion of said fifth electrode operates at said second potential.

8. The tube as described in claim 7, wherein said second portion of said fifth electrode has a dynamic potential applied thereto, said dynamic potential ranging from said second potential to a fourth potential greater than said second potential but substantially less than said third potential.

9. The tube as described in claim 4, wherein each of said openings has a horizontal dimension which is less than a vertical dimension, thereby providing weaker horizontal focusing of the beams prior to entering the main focusing lens.

10. The tube as described in claim 9, wherein said third electrode and said first portion of said fifth electrode operate at said second potential, and said fourth electrode and said sixth electrode operate at said third potential.

11. The tube as described in claim 10, wherein said second portion of said fifth electrode has a dynamic potential applied thereto, said dynamic potential ranging from said second potential to a fifth potential, less positive than said third potential.

* * * * *